US006761255B2

(12) United States Patent
Clements et al.

(10) Patent No.: US 6,761,255 B2
(45) Date of Patent: Jul. 13, 2004

(54) PORTABLE CARRIER

(76) Inventors: Dennis Clements, 555 Elmira Rd., #79, Vacaville, CA (US) 95687; Pamela Clements, 555 Elmira Rd., #79, Vacaville, CA (US) 95687

( * ) Notice: Subject to any disclaimer, the term of this patent is extended or adjusted under 35 U.S.C. 154(b) by 0 days.

(21) Appl. No.: 09/828,372

(22) Filed: Apr. 5, 2001

(65) Prior Publication Data

US 2001/0035319 A1 Nov. 1, 2001

Related U.S. Application Data

(60) Provisional application No. 60/195,122, filed on Apr. 6, 2000.

(51) Int. Cl.[7] ..... A45C 3/00

(52) U.S. Cl. ..... 190/109; 190/100

(58) Field of Search ..... 410/109, 108, 410/110–112, 114, 115, 903, 15.1, 18 R, 18 A; 150/110–115, 117, 118; 383/37, 38–42; 190/109, 108, 110–112, 114, 115, 903, 15.1, 18 R, 18 A, 100

(56) References Cited

U.S. PATENT DOCUMENTS

| | | | |
|---|---|---|---|
| 5,105,920 | A | 4/1992 | Grebenstein |
| 5,676,223 | A | 10/1997 | Cunningham |
| 5,762,170 | A | 6/1998 | Shyr et al. |

*Primary Examiner*—Lee Young
*Assistant Examiner*—Lien Ngo
(74) *Attorney, Agent, or Firm*—Mathew J. Peirce

(57) ABSTRACT

A portable carrier includes compartments for a purse/wallet, an organizer, business documents, lunch, a laptop computer, a pair of shoes, and various other accessories.

18 Claims, 2 Drawing Sheets

PORTABLE CARRIER

This application claims priority from provisional application No. 60/195,122, filed Apr. 6, 2000.

BACKGROUND OF THE INVENTION

The present invention is that of a new and improved apparatus that will consolidate several separate bags and compartments for a traveler or student into a single mobile unit.

DESCRIPTION OF THE PRIOR ART

U.S. Pat. No. 5,762,170, issued to Shyr et al., discloses a combination briefcase and computer bag assembly that includes a housing member having a bottom member, a plurality of side members, and a pair of pivotable top flap members.

U.S. Pat. No. 5,676,223, issued to Cunningham, discloses a business case which comprises a front compartment, middle compartment, an expandable rear compartment, a removable portable computer carrying case designed to carry a portable computer, and a suit carrier.

U.S. Pat. No. 5,105,920, issued to Grebenstein, discloses a zipped suitcase having a top side, two narrow side walls, a bottom part and two large side walls.

SUMMARY OF THE INVENTION

The present invention is that of a new and improved apparatus that will consolidate several separate bags and compartments for a traveler or student into a single mobile unit. The present invention would preferably be designed for a career person or a student constantly on the move, allowing such a person to have virtually everything at their fingertips without the need for excessive searching. The present invention would be in the shape of a "pilot's suitcase," having a set of wheels and a handle for easy mobility. The present invention would include compartments for a purse/wallet, an organizer, business documents, lunch, a laptop computer, a pair of shoes, and various other accessories.

There has thus been outlined, rather broadly, the more important features of a portable carrier in order that the detailed description thereof that follows may be better understood and in order that the present contribution to the art may be better appreciated. There are, of course, additional features of the portable carrier that will be described hereinafter and which will form the subject matter of the claims appended hereto.

In this respect, before explaining at least one embodiment of the portable carrier in detail, it is to be understood that the portable carrier is not limited in its application to the details of construction and to the arrangements of the components set forth in the following description or illustrated in the drawings. The portable carrier is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present portable carrier. It is important, therefore, that the claims be regard as including such equivalent constructions insofar as they do not depart from the spirit and scope of the present invention.

It is therefore an object of the present invention to provide a portable carrier which has all of the advantages of the prior art and none of the disadvantages.

It is another object of the present invention to provide a portable carrier which may be easily and efficiently manufactured and marketed.

It is another object of the present invention to provide a portable carrier which is of durable and reliable construction.

It is yet another object of the present invention to provide a portable carrier which is economically affordable and available for relevant purchasing government entities.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
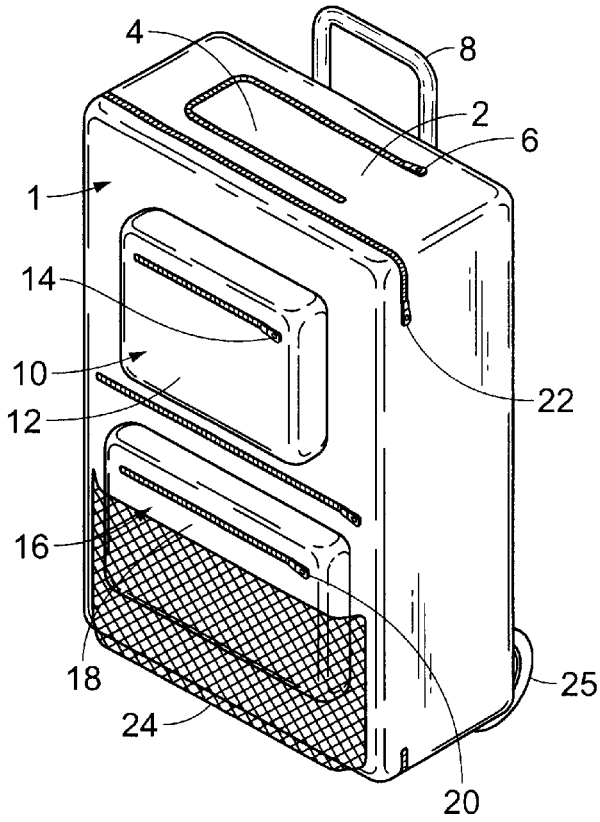
FIG. 1 shows a front perspective view of the front cover of the present invention, while the front cover is closed.

Referring now to FIG. 1, a front perspective view of front cover 1 of the present invention is shown, with front cover 1 being closed. Front cover 1 has an outer surface and an inner surface, with front cover being fixedly attached to the present invention by zipper 22. The present invention is mounted on frame 37.

The present invention includes top compartment 2, which includes top compartment cover 4, which is closable and openable with zipper 6. Top compartment 2 would preferably be used by a user to include Post-It notes, papers, staplers, paper clips, and other small office supplies and materials. Top compartment 2 would allow a user to have quick and ready access to these materials.

The present invention also includes handle 8, which is slidably mounted to frame 37 of the present invention. The present invention also includes a set of wheels 25 and 27, which are bottom-mounted and attached to frame 37. Handle 8 is adjustable, allowing a user to pull along the present invention as they walking by resting the set of wheels on the ground while pulling maintaining a firm grasp on handle 8.

The upper half of front cover 1 of the present invention includes front-mounted upper compartment 10, which includes upper compartment cover 12, which is closable and openable with zipper 14. Upper compartment 10 would preferably be used by a user to include items that a user would need to reach fairly quickly, such as a wallet, airline ticket, identification, or other related items. A user would have wide discretion to place whatever items would be needed in upper compartment 10.

The lower half of front cover 1 of the present invention includes front-mounted lower compartment 16, which includes lower compartment cover 18, which is closable and openable with zipper 20. Lower compartment 16 would preferably be used by a user to include electronic items that a user would regularly use, such as a laptop computer, a beeper, a cell phone, or a dictating machine. In addition, this compartment would be a good location to store magazines or newspapers.

Approximately the lower third of front cover 1 includes attached mesh pocket 24. Mesh pocket 24 would allow a user to store additional objects with the present invention, but would also allow a user to keep these items within plain sight. Mesh pocket 24 would be see-through and would be attached on three sides to the present invention, with the top side of mesh pocket 24 open to allow a user to place items within mesh pocket 24.

Figure 2:
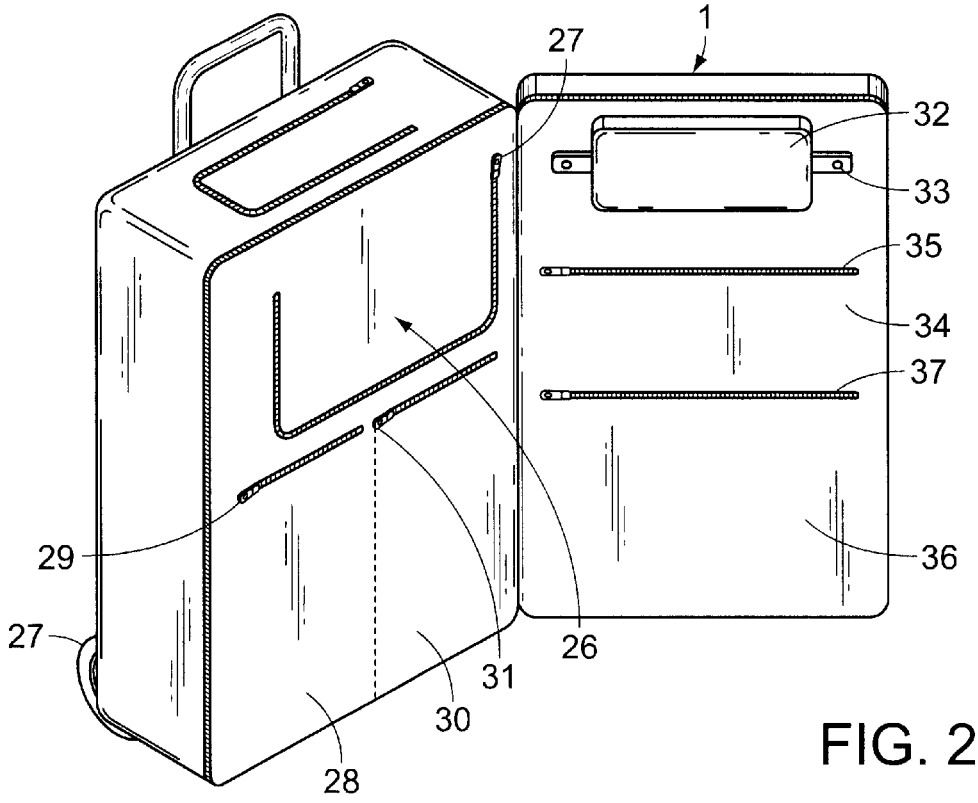
FIG. 2 shows a front perspective view of the front cover of the present invention, while the front cover is open.

FIG. 2 shows a front perspective view of the front cover 1 of the present invention, showing front cover 1 to be open. The inner surface of the front cover 1 of the present invention, in approximately the upper one-fourth of the inner surface, has a place for an attachable wallet 32 to be placed. Attachable wallet 32 would be placed within the present invention with attachment means 33, which would keep attachable wallet 32 fixedly in place but also allow a user to easily detach attachable wallet 32 when contents inside attachable wallet 32 would be needed.

The inner surface of front cover 1 of the present invention would also include makeup compartment 34 and magazine compartment 36, which would be openable and closeable with zippers 35 and 37, respectively. These compartments would provide ready access to needed items.

Approximately the upper one-third of the present invention would comprise food compartment 26, which would allow a user to store meals and extra food. This would be extremely convenient, since typically food while traveling is expensive and not always readily available. This compartment would allow a user to eat food at their convenience, which would greatly assist a user because different users would have different metabolic rates. Food compartment 26 would be openable and closeable with zipper 27.

The lower two-thirds of the present invention would comprise shoe compartment 28 and organizer compartment 30, which a user could use to place a pair of shoes and an organizer, respectively. Shoe compartment 28 would be openable and closeable with zipper 29, while organizer compartment 30 would be openable and closeable with zipper 31.

Figure 3:
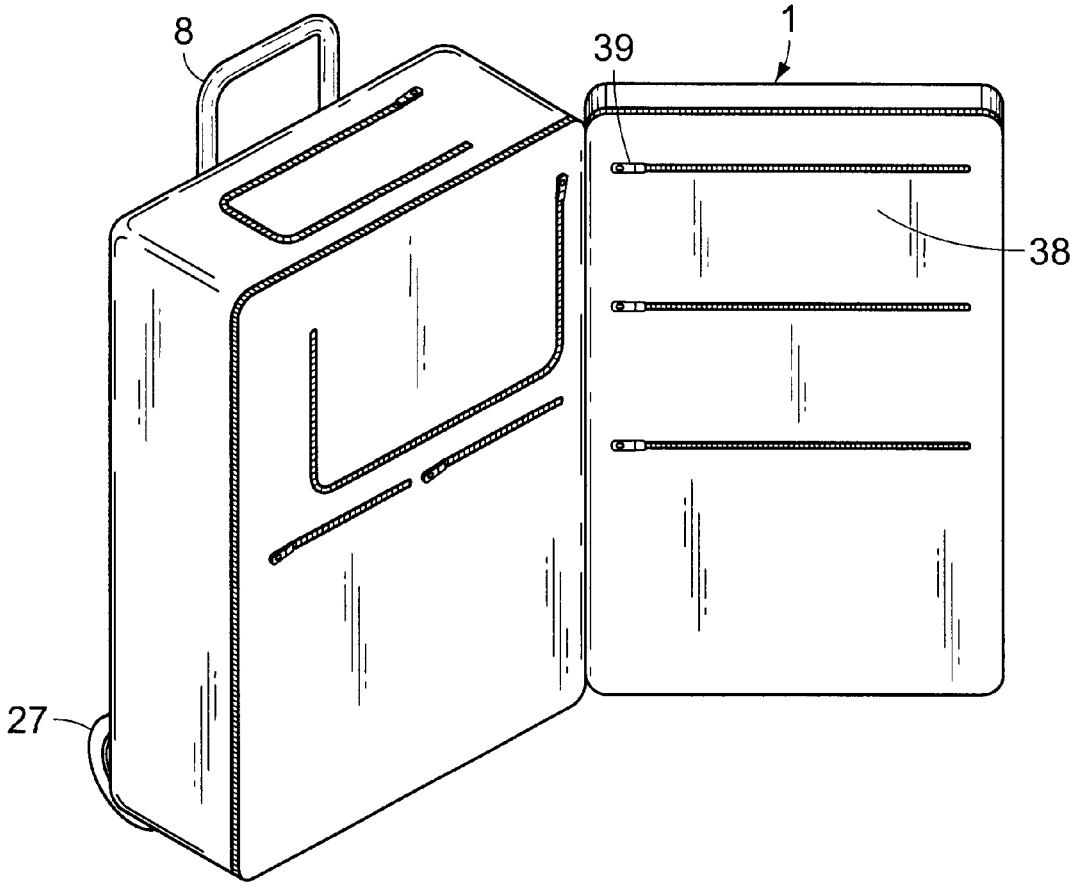
FIG. 3 shows a front perspective view of the front cover of an alternative embodiment of the present invention, while the front cover is open.

FIG. 3 shows a front perspective view of front cover 1 of an alternative embodiment of the present invention, showing front cover 1 as it would be open. This embodiment would preferably be the "men's model," and would be the same as the preferred embodiment except it would lack attachable wallet 32 and would instead include extra compartment 38 in the place of attachable wallet 32. Extra compartment 38 would be openable and closeable with zipper 39.

We claim:

1. A portable carrier comprising:

(a) a frame, (b) a pair of wheels attached to the frame, (c) a briefcase attached to the frame, the briefcase having a front surface and a rear surface, the briefcase including a cover pivotally attached to the front surface of the briefcase, the cover having an inner surface and an outer surface, the outer surface of the cover including an attached upper compartment, the attached upper compartment being openable and closeable with a zipper, the outer surface of the cover also including an attached lower compartment, the attached lower compartment being openable and closeable with a zipper, the outer surface of the cover also having a mesh pocket, the mesh pocket having two sides, a top side and a bottom side, and two ends, a first end and a second end, the first end, the second end, and the bottom side of the mesh pocket being fixedly attached to the outer surface of the cover, the top side of the mesh pocket being open to allow a user to insert objects within the mesh pocket, the inner surface of the cover having an attachable wallet removably attached to the inner surface of the cover, the inner surface of the cover also having two compartments, a middle compartment and a lower compartment, the middle compartment being openable and closeable with a zipper, the lower compartment being openable and closeable with a zipper, the briefcase including a food compartment, the food compartment occupying approximately the upper one-third of the volume of the briefcase, the food compartment being openable and closeable with a zipper, the briefcase also including two lower compartments, a first lower compartment and a second lower compartment, the first lower compartment being openable and closeable with a zipper, the second lower compartment being openable and closeable with a zipper, the briefcase also including a top-mounted compartment, the top-mounted compartment being openable and closeable with a zipper, and (d) a handle, the handle being slidably attached to the frame, the handle being adjustable to accommodate the height of a user.

2. A portable carrier according to claim 1 wherein the attached upper compartment on the outer surface of the cover would preferably be used for storage of wallets, airplane tickets, identification, and other items that are needed frequently and quickly when travelling.

3. A portable carrier according to claim 1 wherein the attached lower compartment on the outer surface of the cover would preferably be used for storage of electronic items.

4. A portable carrier according to claim 1 wherein the middle compartment on the inner surface of the cover would preferably be used for storage of makeup and toiletries.

5. A portable carrier according to claim 1 wherein the lower compartment on the inner surface of the cover would preferably be used for storage of magazines, books, newspapers, and other related reading materials.

6. A portable carrier according to claim 1 wherein the food compartment within the briefcase would preferably be used for storage of food.

7. A portable carrier according to claim 1 wherein the first lower compartment within the briefcase would preferably be used for storage of shoes.

8. A portable carrier according to claim 1 wherein the second lower compartment within the briefcase would preferably be used for storage of an organizer and related time-management materials.

9. A portable carrier according to claim 1 wherein the top-mounted compartment would be preferably used for storage of office supplies.

10. A portable carrier comprising:

(a) a frame, (b) a pair of wheels attached to the frame, (c) a briefcase attached to the frame, the briefcase having a front surface and a rear surface, the briefcase including a cover pivotally attached to the front surface of the briefcase, the cover having an inner surface and an outer surface, the outer surface of the cover including an attached upper compartment, the attached upper compartment being openable and closeable with a zipper, the outer surface of the cover also including an attached lower compartment, the attached lower compartment being openable and closeable with a zipper, the outer surface of the cover also having a mesh pocket, the mesh pocket having two sides, a top side and a bottom side, and two ends, a first end and a second end, the first end, the second end, and the bottom side of the mesh pocket being fixedly attached to the outer surface of the cover, the top side of the mesh pocket being open to allow a user to insert objects within the mesh pocket, the inner surface of the cover having three compartments, an upper compartment, a middle compartment and a lower compartment, the upper compartment being openable and closeable with a zipper, the middle compartment being openable and closeable with a zipper, the lower compartment being openable and closeable with a zipper, the briefcase including a food compartment, the food compartment occupying approximately the upper one-third of the volume of the briefcase, the food compartment being openable and closeable with a zipper, the briefcase also including two lower compartments, a first lower compartment and a second lower compartment, the first lower compartment being openable and closeable with a zipper, the second lower compartment being openable and closeable with a zipper, the briefcase also including a top-mounted compartment, the top-mounted compartment being openable and closeable with a zipper, and (d) a handle, the handle being slidably attached to the frame, the handle being adjustable to accommodate the height of a user.

11. A portable carrier according to claim 10 wherein the attached upper compartment on the outer surface of the cover would preferably be used for storage of wallets, airplane tickets, identification, and other items that are needed frequently and quickly when travelling.

12. A portable carrier according to claim 10 wherein the attached lower compartment on the outer surface of the cover would preferably be used for storage of electronic items.

13. A portable carrier according to claim 10 wherein the middle compartment on the inner surface of the cover would preferably be used for storage of makeup and toiletries.

14. A portable carrier according to claim 10 wherein the lower compartment on the inner surface of the cover would preferably be used for storage of magazines, books, newspapers, and other related reading materials.

15. A portable carrier according to claim 10 wherein the food compartment within the briefcase would preferably be used for storage of food.

16. A portable carrier according to claim 10 wherein the first lower compartment within the briefcase would preferably be used for storage of shoes.

17. A portable carrier according to claim 10 wherein the second lower compartment within the briefcase would preferably be used for storage of an organizer and related time-management materials.

18. A portable carrier according to claim 10 wherein the top-mounted compartment would be preferably used for storage of office supplies.

* * * * *